US009496640B1

(12) United States Patent
Middleton et al.

(10) Patent No.: US 9,496,640 B1
(45) Date of Patent: Nov. 15, 2016

(54) SOCKET PROTECTOR

(71) Applicants: Travis Arthur Middleton, Knoxville, GA (US); Daniel Ray Hammer, Atlanta, GA (US); Grzegorz Wronski, Peachtree City, GA (US)

(72) Inventors: Travis Arthur Middleton, Knoxville, GA (US); Daniel Ray Hammer, Atlanta, GA (US); Grzegorz Wronski, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 341 days.

(21) Appl. No.: 14/021,695

(22) Filed: Sep. 9, 2013

(51) Int. Cl.
*F21V 17/06* (2006.01)
*H01R 13/52* (2006.01)
*F21V 17/00* (2006.01)

(52) U.S. Cl.
CPC ..... *H01R 13/5213* (2013.01); *F21V 17/007* (2013.01)

(58) Field of Classification Search
CPC ..... F21V 17/007; H01R 13/5213
USPC ..... 362/437; 439/892–893
See application file for complete search history.

(56) References Cited

U.S. PATENT DOCUMENTS

| | | | | |
|---|---|---|---|---|
| 6,481,875 | B1 | 11/2002 | Bryant | |
| 6,824,404 | B1 | 11/2004 | Sugar | |
| 7,014,482 | B1 | 3/2006 | Sugar | |
| 7,547,121 | B1 * | 6/2009 | Rashidi | F21S 8/02 362/147 |
| 2002/0123255 | A1 | 9/2002 | Kertesz | |
| 2013/0003394 | A1 * | 1/2013 | Foltz | F21S 6/002 362/382 |

* cited by examiner

*Primary Examiner* — Sean Gramling
(74) *Attorney, Agent, or Firm* — King & Spalding LLP

(57) ABSTRACT

A socket protector includes a socket attachment portion and a fixture attachment portion disposed adjacent to the socket attachment portion. The socket attachment portion can include at least one pair of socket attachment features, where the at least one pair of socket attachment features is configured to detachably couple to a socket of a light fixture. The fixture attachment portion can include at least one fixture attachment feature, where the at least one fixture attachment feature detachably couples to at least one housing feature of a number of housing features of a housing of the light fixture.

19 Claims, 9 Drawing Sheets

SOCKET PROTECTOR

TECHNICAL FIELD

The present disclosure relates generally to methods, systems, and devices for protecting a socket, and more particularly, to socket protectors to protect a socket during shipping and installation.

BACKGROUND

Some lighting fixtures are manufactured and shipped with the socket positioned inside the fixture but unattached to the fixture. Oftentimes, the socket is made of ceramic or some other breakable material. Currently, to prevent breakage during shipping, the socket is restrained in a cardboard cutout or attached to a metal bracket, which is placed within the packaging for the lighting fixture.

In addition, the socket must be protected from contamination that can occur during installation. Without protecting the socket during installation, paint, spackling paste, dust, dirt, and other contaminants can enter the socket. These contaminants can cover the electrical contacts of the socket, having a detrimental effect on the functionality of the fixture. Currently, a plastic plug is inserted into the socket to prevent contamination during installation.

SUMMARY

In general, in one aspect, the disclosure relates to a socket protector. The socket protector can include a socket attachment portion having at least one pair of socket attachment features, where the at least one pair of socket attachment features is configured to detachably couple to a socket of a light fixture. The socket protector can also include a fixture attachment portion disposed adjacent to the socket attachment portion, where the fixture attachment portion includes at least one fixture attachment feature, where the at least one fixture attachment feature is configured to detachably couple to at least one housing feature of a plurality of housing features of a housing of the light fixture.

In another aspect, the disclosure can generally relate to a socket protector. The socket protector can include a socket attachment portion that includes a plug that is configured to be disposed within and detachably coupled to at least a portion of a cavity of a socket. The socket protector can also include a fixture attachment portion disposed adjacent to the socket attachment portion, where the fixture attachment portion includes at least one fixture attachment feature, where the at least one fixture attachment feature is configured to detachably couple to at least one housing feature of a plurality of housing features of a housing of a light fixture.

These and other aspects, objects, features, and embodiments will be apparent from the following description and the appended claims.

BRIEF DESCRIPTION OF THE DRAWINGS

The drawings illustrate only example embodiments of socket protectors and are therefore not to be considered limiting of its scope, as socket protectors may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1A:
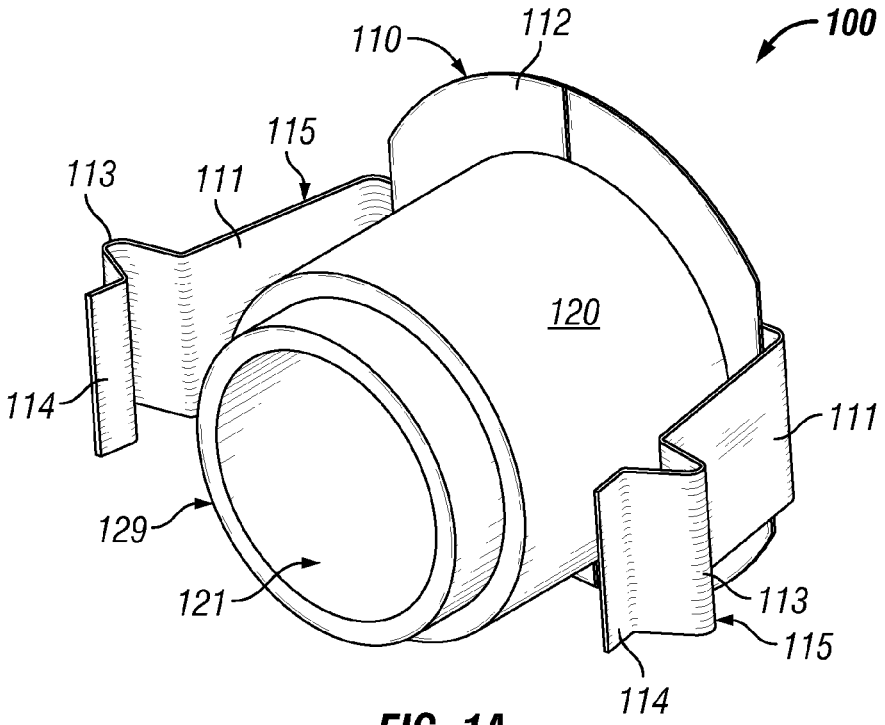
FIGS. 1A and 1B show various sockets with which example socket protectors can be used.

The example embodiments discussed herein are directed to systems, apparatuses, and methods of protecting a socket for a light fixture during shipping and installation. Example embodiments of socket protectors can be used for any type of socket for any type of light fixture. Examples of socket types that can be used with example socket protectors can include, but are not limited to, type H, type K, and type S. Such sockets can be used for any of a number of types of light sources, including but not limited to light-emitting diode (LED), incandescent, compact fluorescent, halogen, and mercury. The example socket protectors can be used with sockets of any size and any shape.

A user as described herein may be any person that is involved with installation and/or maintenance of a light fixture. Examples of a user may include, but are not limited to, a company representative, an electrician, an engineer, a mechanic, an operator, a consultant, a contractor, and a manufacturer's representative.

Example embodiments of socket protectors will be described more fully hereinafter with reference to the accompanying drawings, in which example embodiments of socket protectors are shown. Socket protectors may, however, be embodied in many different forms and should not be construed as limited to the example embodiments set forth herein. Rather, these example embodiments are provided so that this disclosure will be thorough and complete, and will fully convey the scope of socket protectors to those of ordinary skill in the art. Like, but not necessarily the same, elements (also sometimes called components) in the various figures are denoted by like reference numerals for consistency. Terms such as "first," "second," "distal," "proximal," "left," "right," "front," and "back" are used merely to distinguish one component (or part of a component) from another. Such terms are not meant to denote a preference or a particular orientation.

Figure 1B:
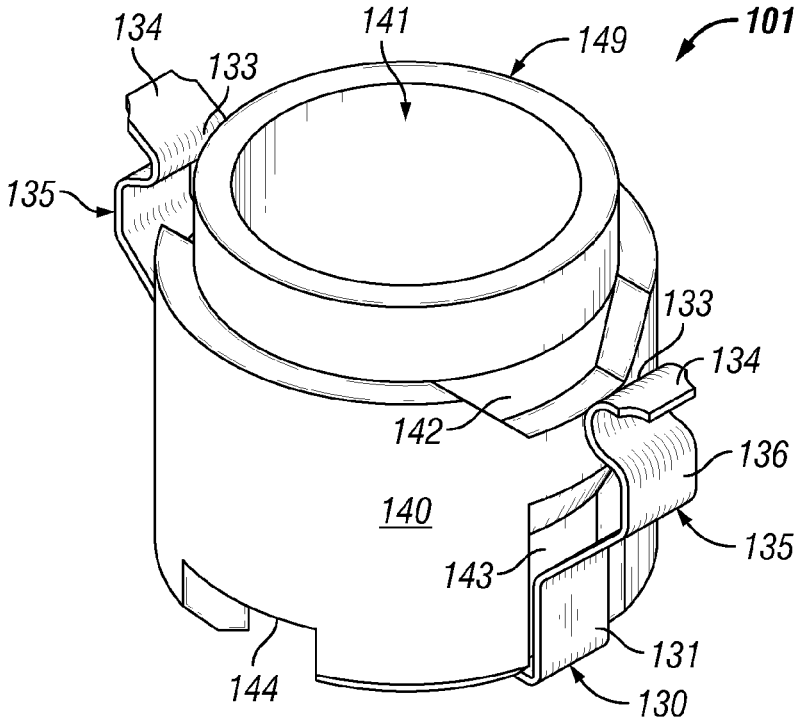

FIGS. 1A and 1B show various sockets with which example socket protectors can be used. Specifically, FIG. 1A shows a perspective view of a socket 100, while FIG. 1B shows a perspective view of a different socket 101. In one or more embodiments, one or more of the features shown in FIGS. 1A and 1B may be omitted, repeated, and/or substituted. Accordingly, embodiments of sockets with which example socket protectors can be used should not be considered limited to the specific arrangements of components shown in FIGS. 1A and 1B.

Referring now to FIGS. 1A and 1B, the socket 100 has a body 129 that can include one or more walls 120 that form a cavity 121 into which a light source (not shown) can be disposed. The body 129 can be made of one or more of a number of materials, including but not limited to ceramic, plastic, and metal. In some cases, the material (e.g., ceramic) used for the body 129 is breakable, and so protecting the body 129 of the socket 100 can be important in the shipping and/or installation of the socket 100 in a light source.

The socket 100 can also include a mounting portion 110. The mounting portion 110 can be mechanically coupled to any portion (in this example, to the distal end opposite where the open end of the cavity 121) of the body 129. The mounting portion 110 can include one or more of a number of features that allow the socket 100 to mechanically couple to a portion of the light fixture. For example, as shown in FIG. 1A, the mounting portion 110 can include a pair of mounting clips 115 that are each attached to a base 112 of the mounting portion 110. In certain example embodiments, the base 112 is made of a thermally insulating material that prevents heat generated by the body 129 from transferring to the mounting clips 115. The base 112 can be affixed to (or disposed over) the distal end of the body 129. Each mounting clip 115 can have an extension arm 111 that is mechanically coupled to the base at one (proximal) end.

The other (distal) end of the extension arm 111 can have one or more coupling features. Examples of such coupling features can include, but are not limited to, a bend, a twist, a tab, a slot, and a separate piece mechanically coupled to the extension arm 111. In this case, the distal end of each extension arm 111 has a number of bends in it. Specifically, moving toward the distal end, the extension arm 111 has an outward bend 113 that creates a somewhat narrow profile. The return of the outward bend 113 bends to a tab 114 that is substantially on plane with the proximal end of the extension arm 111. Each of the pair of mounting clips 115 can be disposed on opposite sides of the body 120 of the socket 100.

The mounting clips 115 can be made of a flexible material that returns to a default position after a force applied to it is removed. Examples of such material can include, but are not limited to, metal and plastic. The various components of the mounting portion 110 can be a single piece (as from a mold) or can be multiple pieces that are mechanically coupled to each other using one or more of a number of coupling methods. Examples of such coupling methods can include, but are not limited to, fastening devices, connectors, mating threads, welding, snap fittings, and compression fittings.

The socket 101 of FIG. 1B is substantially the same as the socket 100 of FIG. 1A, except as described below. The body 149 of the socket 101 can have one or more features (e.g., recess 142 and recess 143) to provide for an integrated mounting portion 130. Specifically, the mounting portion 130 of FIG. 1B does not have a base. Instead, the extension arm 131 fits within recess 143, which runs along the distal end of the body 149. The extension arm 131 can be common for both mounting clips 135.

Each mounting clip 135 in this example is formed by first bending an end of the extension arm 131 outward, away from the body 140 before flattening out to portion 136, which is substantially parallel to the extension arm 131. Moving further toward the distal end, the extension arm 131 is bent inward to form a rounded inward-facing portion 133 before forming a more sharply outward-directed portion 134 at the far distal end. Portion 136 can fit over the part of the body 149 that is positioned between recess 142 and recess 143. When an inward force is applied to the mounting clip 135, the portion 133 can be disposed within recess 142.

The body 149 of the socket 140 can include one or more walls 140 that form a cavity 141 into which a light source (not shown) can be disposed. The body 149 can also include one or more recesses (e.g., recess 144) disposed along the distal end of the body 149 for allowing one or more wires (not shown) to pass therethrough.

Figure 2:
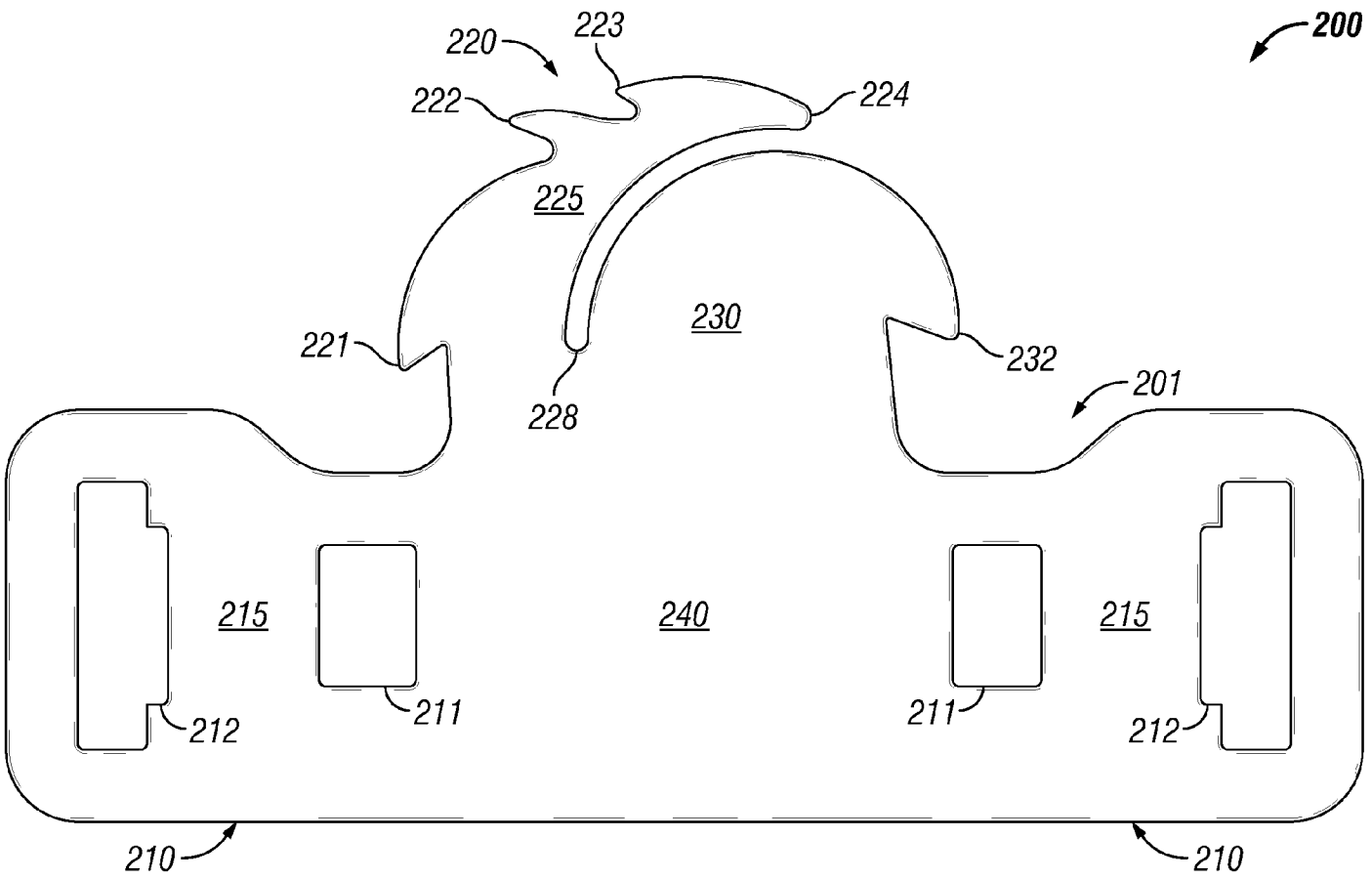
FIG. 2 shows a front view of an example socket protector in accordance with one or more example embodiments.

FIG. 2 shows a front view of an example socket protector 200 in accordance with one or more example embodiments. In one or more embodiments, one or more of the features shown in FIG. 2 may be omitted, repeated, and/or substituted. Accordingly, embodiments of socket protectors should not be considered limited to the specific arrangements of components shown in FIG. 2.

Referring to FIGS. 1A-2, the socket protector 200 can include a socket attachment portion 201 and a fixture attachment portion 220. The socket attachment portion 201 and the fixture attachment portion 220 can be a single piece formed from, for example, a mold or a stamping process. Alternatively, the socket attachment portion 201 and the fixture attachment portion 220 can be separate pieces that are mechanically coupled to each other using one or more of a number of coupling methods. Examples of such coupling methods can include, but are not limited to, fastening devices, mating threads, welding, epoxy. snap fittings, and compression fittings. In any case, the socket protector 200 (including the socket attachment portion 201 and the fixture attachment portion 220) can be flexible (e.g., bendable). Some or all of the socket protector 200 can be made of one or more of a number of materials, including but not limited to plastic, metal, and rubber.

Figure 13:
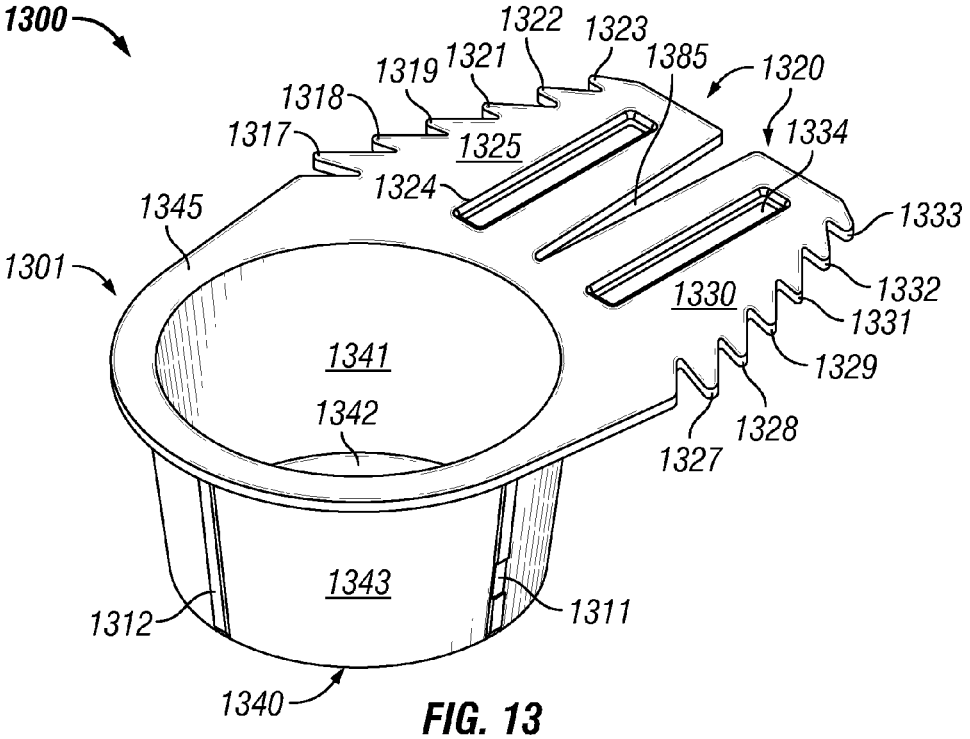
FIG. 13 shows a perspective view of yet another example socket protector in accordance with one or more example embodiments.

In certain example embodiments, the socket protector 200 can be essentially two-dimensional, where the thickness of the socket protector 200 is small relative to the width and the height of the socket protector 200. Alternatively, as shown in FIG. 13 below, the socket protector (or certain portions thereof) can be three dimensional, where the thickness is a significant dimension to the socket protector.

In certain example embodiments, the socket attachment portion 201 is used to couple the socket protector 200 to a socket (e.g., socket 100, socket 101). Specifically, the mounting clips (e.g., mounting clips 115, mounting clips 135) of a socket can be used to mechanically and detachably couple to a pair of socket attachment sections 210 of the socket protector 200. A socket protector 200 can have one or more than one pair of socket attachment sections 210. In addition, or in the alternative, each socket attachment section 210 can have one or more socket attachment features (e.g., socket attachment feature 211, socket attachment feature 212). For example, in this case, the socket protector 200 has two socket attachment sections 210, and each socket attachment section 210 has half of a pair of two socket attachment features: Socket attachment features 211 and socket attachment features 212. Each pair of socket attachment features can be shaped substantially identical to each other and positioned on the attachment body 215 of the socket protector 200 as mirror images of each other. Alternatively, one socket attachment feature of a pair of socket attachment features can be shaped different than the other socket attachment feature of the pair.

Each socket attachment feature can be an aperture that traverses the thickness of the attachment body 215 of the socket attachment section 210. Such an aperture can have one or more of a number of shapes and sizes. For example, the socket attachment features 211 shown in FIG. 2 are rectangular in shape, while the socket attachment features 212 are more elongated, narrower, and include an inwardly-disposed recess when compared to the socket attachment features 211. In certain example embodiments, the spacing, shape, and size of each pair of socket attachment features corresponds to one or more sockets having mounting clips with substantially similar spacing, shapes, and sizes.

When a socket protector 200 includes more than one (e.g., two, three, four) pair of socket attachment features, the pairs of socket attachment features can be positioned concentrically on the attachment body 215, as shown in FIG. 2. In other words, socket attachment features 211 can be disposed closer to the optional main body 240 (or the aperture in the socket protector 200 located between each socket attachment section 210) of the socket attachment portion 201, while the socket attachment features 212 are spaced further away from the main body 240 (or the aperture in the socket protector 200 located between each socket attachment section 210) of the socket attachment portion 201. The spacing between the socket attachment features on one attachment body 215 of one socket attachment section 210 disposed on one side of the main body 240 can be the same or different than the spacing between the socket attachment features on the attachment body 215 of the socket attachment section 210 disposed on the opposite side of the main body 240. Each pair of socket attachment features can be shaped, sized, and spaced apart to receive the mounting clips (or other attachment features of the socket) of one or more of a number (or range) of sockets.

Figure 16:
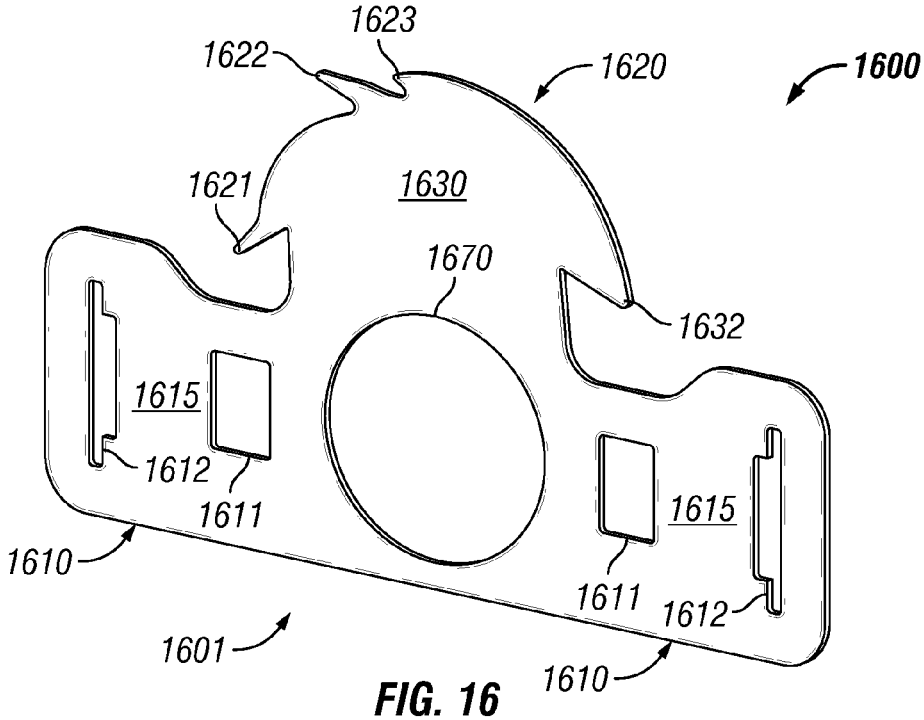
FIG. 16 shows a front view of yet another example socket protector in accordance with one or more example embodiments.

In certain example embodiments, the optional main body 240 is positioned between each socket attachment section 210. When the mounting clips of the socket are engaged with a pair of socket attachment features of the socket protector 200, the main body 240 can be disposed over some or all of the cavity (e.g., cavity 121, cavity 141) of a socket. The main body 240 can be a solid piece with no apertures, slots, or other features that could allow dust and other contaminants from passing into the cavity of a socket when the mounting clips of the socket are engaged with a pair of socket attachment features of the socket protector 200. The main body 240 can be used to protect at least part of the cavity of the socket during transportation of an associated light fixture and/or during installation of the light fixture. If there is no main body 240, as shown in FIG. 16 below, there is an aperture (not shown) that can be of any size and/or shape. In such a case, the aperture can be located between each socket attachment section 210.

A pair of mounting clips (e.g., mounting clips 115, mounting clips 135) can be mechanically coupled to a pair of socket attachment features (e.g., socket attachment feature 211, socket attachment feature 212) in one or more of a number of ways. For example, the pair of mounting clips can be compressed toward each other or expanded away from each other. When the force applied to the pair of mounting clips to force them to compress toward each other or expand away from each other is removed, the pair of mounting clips return to substantially their default position. By applying a compressive or expanding force to the mounting clips, the contours and/or features of the mounting clips can be positioned relative to a pair of socket attachment features of the socket protector 200 in such a way that the distal end of the mounting clips can traverse the socket attachment features.

Thus, when the compressive or expanding force applied to the mounting clips is removed after the distal end of the mounting clips traverses the socket attachment features, each mounting clip, in its default position, presses against an edge of the socket attachment feature that the distal end of the mounting clip traverses. As a result, the mounting clips hold the socket protector 200 in place relative to the socket until another compressive or expanding force applied to the mounting clips. In such a case, if the mounting clips and/or the socket protector 200 is moved apart from each other, the socket protector 200 can be decoupled from the mounting clips of the socket. In other words, a socket can be detachably coupled to a pair of socket attachment features of the socket protector 200.

In certain example embodiments, the fixture attachment portion 220 of the socket protector 200 is used to couple the socket protector 200 to one or more housing features (shown and described below with respect to FIGS. 4-7) of a housing for a light fixture. Specifically, the fixture attachment portion 220 can include at least one fixture attachment feature (e.g., fixture attachment feature 221, fixture attachment feature 232) that can mechanically and detachably couple to at least one housing feature of a housing. The shape, size, and position of the fixture attachment features can provide flexibility so that the fixture attachment portion 220 can mechanically couple to any of a number of housing features of a housing.

The fixture attachment portion 220 can have one or more sections disposed along one or more portions of the socket attachment portion 201. In such a case, each section can mechanically and detachably couple to at least one housing feature of the housing of the light fixture. In the example shown in FIG. 2, the fixture attachment portion 220 includes two sections, section 225 and section 230. In such a case, each section can include one or more fixture attachment features. In this example, section 225 includes fixture attachment feature 221, fixture attachment feature 222, fixture attachment feature 223, and fixture attachment feature 224. Section 230 includes fixture attachment feature 232. A section of the fixture attachment portion 220 can have a single fixture attachment feature or multiple fixture attachment features.

Figure 10:
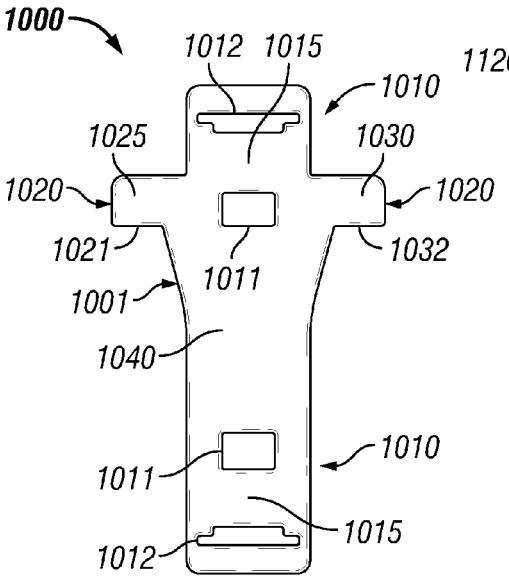
FIG. 10 shows a front view of yet another example socket protector in accordance with one or more example embodiments.
Figure 11:
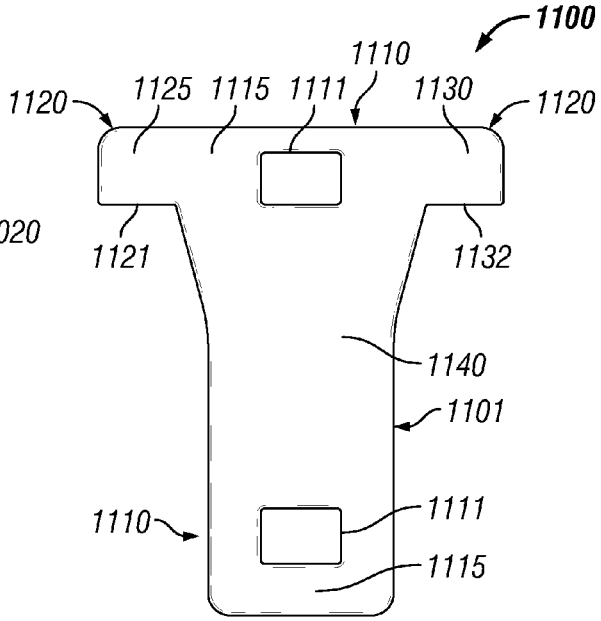
FIG. 11 shows a front view of still another example socket protector in accordance with one or more example embodiments.

In certain example embodiments, there is a physical separation between multiple sections of the fixture attachment portion 220. For example, in this case, section 225 and section 230 are disposed on the same side of the socket attachment portion 201, and a gap 228 separates section 225 and section 230. The curved gap 228 in this example allows for independent movement of the section 225 and section 230 relative to each other. In addition, or in the alternative, as shown in FIGS. 10 and 11 below, multiple sections of the fixture attachment portion 220 can be disposed on multiple sides (e.g., opposite sides) of the socket attachment portion 201.

Each fixture attachment feature of a section of the fixture attachment portion 220 can have any of a number of shapes and/or sizes. For example, in FIG. 2, fixture attachment feature 221, fixture attachment feature 222, and fixture attachment feature 223 of section 225 are disposed along the outer perimeter of section 225 like uneven and unequal teeth on a circular saw blade. Fixture attachment feature 224 is a rounded edge at the distal point of section 225. Fixture attachment feature 232 is an extended edge on the far right side of section 230. In certain example embodiments, the end of the gap 228 between section 225 and section 230 can be a fixture attachment feature.

Figure 3:
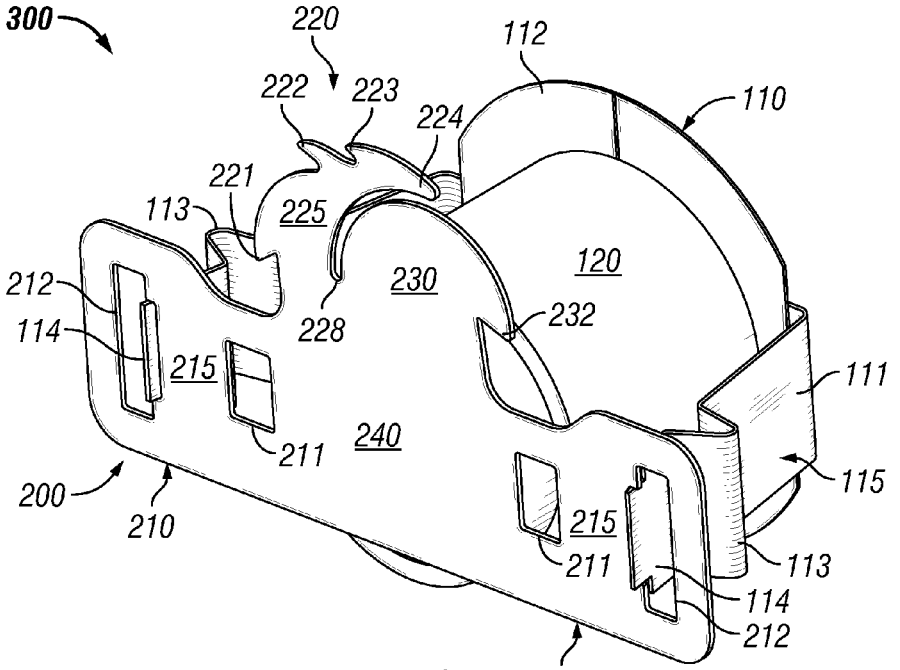
FIG. 3 shows a system that includes the socket of FIG. 1A coupled to the example socket protector of FIG. 2 in accordance with one or more example embodiments.

FIG. 3 shows a system 300 that includes the socket 100 of FIG. 1A coupled to the example socket protector 200 of FIG. 2 in accordance with one or more example embodiments. In one or more embodiments, one or more of the features shown in FIG. 3 may be omitted, repeated, and/or substituted. Accordingly, embodiments of socket protectors attached to sockets should not be considered limited to the specific arrangements of components shown in FIG. 3.

Referring to FIGS. 1A, 2, and 3, the system 300 shows the socket protector 200 mechanically coupled to the socket 100. Specifically, both mounting clips 115 of the socket 100 are disposed within the pair of socket attachment features 212 of the socket attachment sections 210 of the socket protector 200. In such a case, the tab 114 at the proximal end of each extension arm 111 can extend through socket attachment features 212 disposed on either side of the main body 240. In certain example embodiments, one or more other features of the mounting clips 115 (e.g., the outward bend 113) can also traverse the socket attachment features 112.

The width of the tab 114 and other portions of the mounting clips 115 that are disposed in the socket attachment features 212 can be substantially the same as the width of the socket attachment features 212. For example, the width of the inwardly-disposed recess of each socket attachment feature 212 can have a width that is substantially the same as, or slightly larger than, the width of the tab 114, so that the tabs 114 can be disposed in the inwardly-disposed recesses of the socket attachment features 212 when the socket protector 200 is mechanically coupled to the socket 100. When the socket protector 200 is mechanically coupled to the socket 100, the main body 240 of the socket protector 200 covers most or all of the cavity 121 of the socket 100.

To decouple the socket protector 200 from the socket 100, a user applies an outward force to the mounting clips 115 so that the tabs 114 (or other portion of the mounting clips 115) can be removed from the inwardly-disposed recesses of the socket attachment features 212 and into the wider central portion of the socket attachment features 212. In so doing, the tabs 114 (and/or other portions of the mounting clips 115) can pass through the socket attachment features 212 in the opposite direction in which the tabs 114 coupled to the socket attachment features 212.

Figure 4:
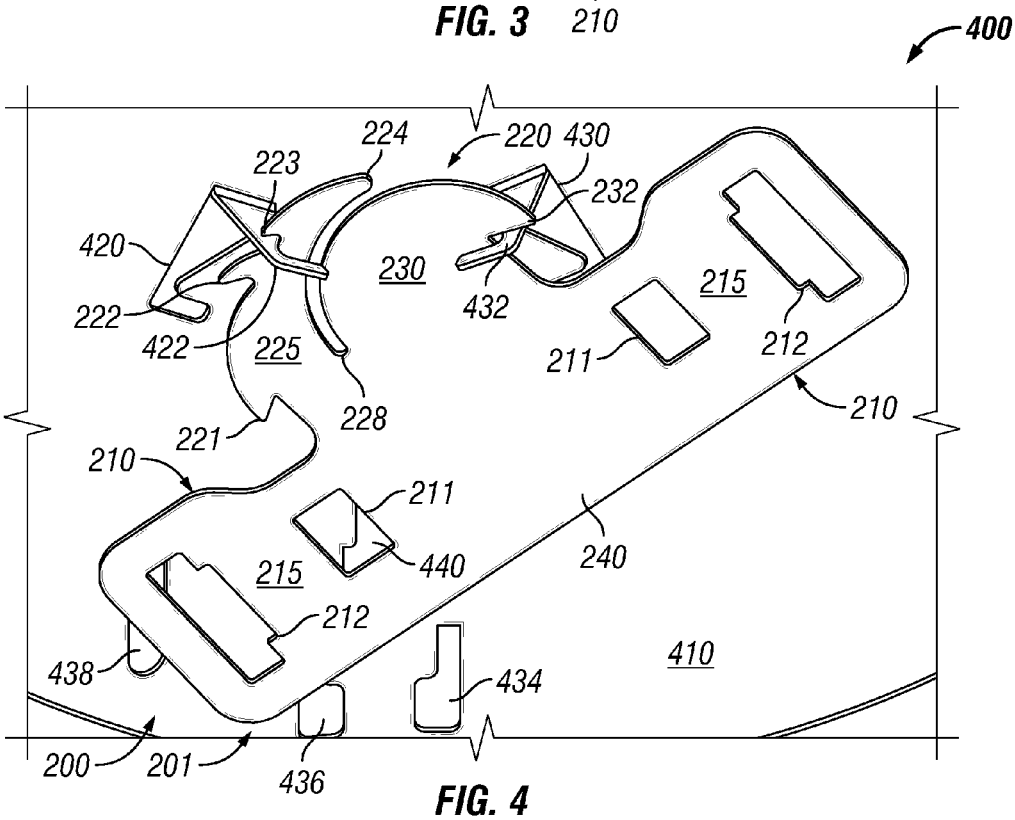
FIG. 4 shows the example socket protector of FIG. 2 coupled to multiple housing features of a light fixture in accordance with one or more example embodiments.

FIG. 4 shows the example socket protector 200 of FIG. 2 coupled to multiple housing features of a light fixture 400 in accordance with one or more example embodiments. In one or more embodiments, one or more of the features shown in FIG. 4 may be omitted, repeated, and/or substituted. Accordingly, embodiments of light fixtures that include socket protectors should not be considered limited to the specific arrangements of components shown in FIG. 4.

Referring to FIGS. 1A-4, the light fixture 400 includes a housing 410. Disposed along the housing 410 (or, more specifically, a wall of the housing 410) are a number of apertures (e.g., aperture 420, aperture 430, aperture 434, aperture 436, aperture 438, aperture 440). One or more of these apertures can be called a housing feature. These apertures can have one or more of a number of shapes and sizes. An aperture can be used to cut-out a space in the housing 410 and/or to allow a portion of the housing 410 to protrude inward or outward from the rest of the housing 410. As an example of the latter case, aperture 420 in the housing 410 allows protrusion 422 to be bent inward from the housing 410. In such a case, the protrusion 422 (a type of housing feature 422) can be a mounting hook for a fixture attachment feature (in this case, fixture attachment feature 223) of the fixture attachment portion 220 of the socket protector 200. As another example, aperture 430 in the housing 410 allows protrusion 432 (a type of housing feature 432) to be bent inward from the housing 410. In such a case, the protrusion 432 can be a mounting hook for a different fixture attachment feature (in this case, fixture attachment feature 232) of the fixture attachment portion 220 of the socket protector 200.

Aside from being bent back toward or further away from the aperture 420 and 430 by a user, housing feature 422 and housing feature 432 are substantially fixed in place. Further, the housing feature 422 and the housing feature 432 can be faced in substantially opposite directions (in this case, inward toward each other). Thus, for both fixture attachment feature 223 and fixture attachment feature 232 to detachably couple to housing feature 422 and housing feature 432, respectively, the flexible characteristics of the fixture attachment portion 220 are used. In this example, the curved gap 228 allow the section 225 and section 230 to be pressed toward each other, which in turn allows fixture attachment feature 223 and fixture attachment feature 232, which are facing in substantially opposite directions from each other (in this case, outward away from each other), to be pressed toward each other. As a result, once fixture attachment feature 223 is placed in a certain position relative to the housing feature 422 and fixture attachment feature 232 is placed in a certain position relative to the housing feature 432, when the compressive force that presses section 225 and section 230 toward each other is released, fixture attachment feature 223 couples to housing feature 422 and fixture attachment feature 232 couples to housing feature 432.

If housing feature 422 and housing feature 432 is spaced a different distance (e.g., further apart) from each other on the housing 410, then one or more other fixture attachment features (e.g., fixture attachment feature 221) can be used to couple the socket protector 200 to the housing 410. The fixture attachment portion 220 of the socket protector 200 can be detachably coupled to one housing feature or to more than two housing features. A housing feature can be a protrusion, an aperture (e.g., aperture 436, aperture 434, aperture 438, aperture 440), and/or any other feature disposed on the housing 410. Housing feature 422 and housing feature 432 can be separate housing features. Alternatively, housing feature 422 and housing feature 432 can be part of a single housing feature.

Figure 5:
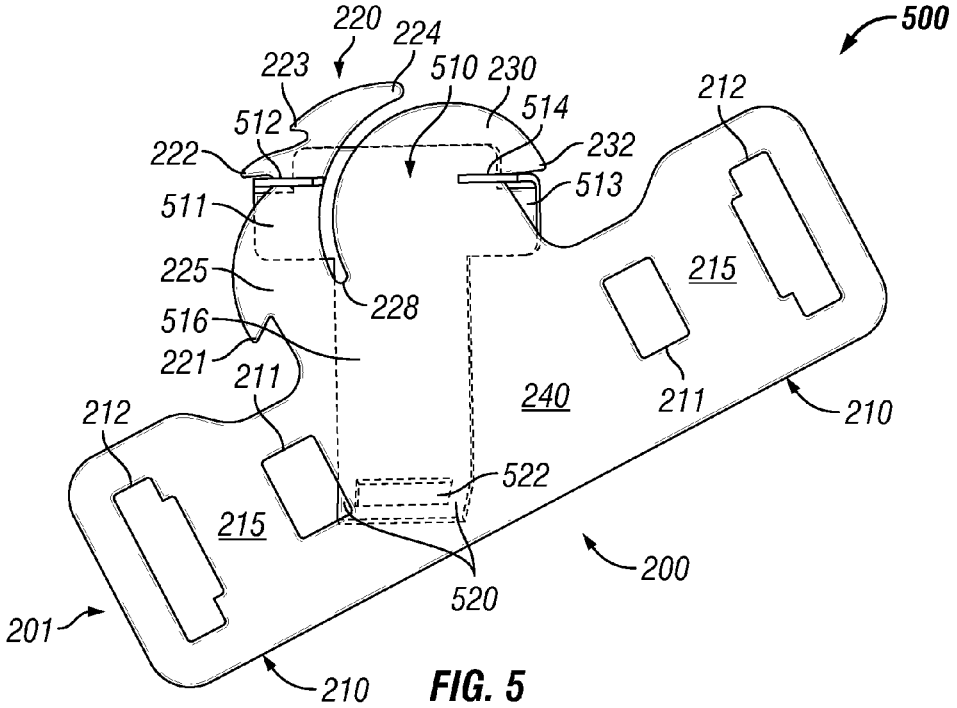
FIG. 5 shows the example socket protector of FIG. 2 coupled to another housing feature of a light fixture in accordance with one or more example embodiments.

FIG. 5 shows a semi-transparent front view of a portion of a light fixture 500 that includes the example socket protector 200 of FIG. 2 coupled to another housing feature 510 of the housing 410 of FIG. 4 in accordance with one or more example embodiments. In one or more embodiments, one or more of the features shown in FIG. 5 may be omitted, repeated, and/or substituted. Accordingly, embodiments of light fixtures that include socket protectors should not be considered limited to the specific arrangements of components shown in FIG. 5.

Referring to FIGS. 1A-5, the portion of the light fixture 500 includes the housing 410, as described above with respect to FIG. 4. Disposed along the housing 410 of this portion of the light fixture 500 is a housing feature 510 in the form of a mounting bracket (i.e., mounting bracket 510). The mounting bracket 510 can be part of a single piece with the housing 410, formed as from a mold. Alternatively, the mounting bracket 510 can be a separate piece mechanically coupled to the housing 410 using one or more of a number of coupling methods, including but not limited to welding, rivets, clamps, mating threads, and epoxy.

The mounting bracket 510 can include one or more of a number of features for securing a component (e.g., a connector) of the light fixture 500 and/or a portion (e.g., trim) of the lighting fixture 500. The mounting bracket 510 in this case can include a bottom frame 520 that forms an aperture 522 through which a portion of the component and/or portion of the lighting fixture 500 can be disposed. The bottom frame 520 is attached to, and forms an angle (e.g., approximately 60°, approximately 90°) with, the main body 516 of the mounting bracket 510. At the top of the main body 516 are a right side extension 513 and a left side extension 511. The right side extension 513 can include a bracket feature 514, and the left side extension 511 can include a bracket feature 512. Bracket feature 512 and bracket feature 514 can be used to secure a different portion of the component.

If the component that is disposed within the mounting bracket 510 is not disposed within the mounting bracket 510 during shipping, then the socket protector 200 can be detachably coupled to the mounting bracket 510. For example, as shown in FIG. 5, bracket feature 512 can be detachably coupled to fixture attachment feature 222 of portion 225 of the fixture attachment portion 220, and bracket feature 514 can be detachably coupled to fixture attachment feature 232 of portion 230 of the fixture attachment portion 220. In such a case, the bottom frame 520 of the mounting bracket 510 can come into contact with the main body 240 when the socket protector 200 is coupled to the mounting bracket 510. The fixture attachment portion 220 of the socket protector 200 can couple to and decouple from the mounting bracket 510 using the flexibility of the fixture attachment portion 220, as described above with respect to FIG. 4.

Figure 6:
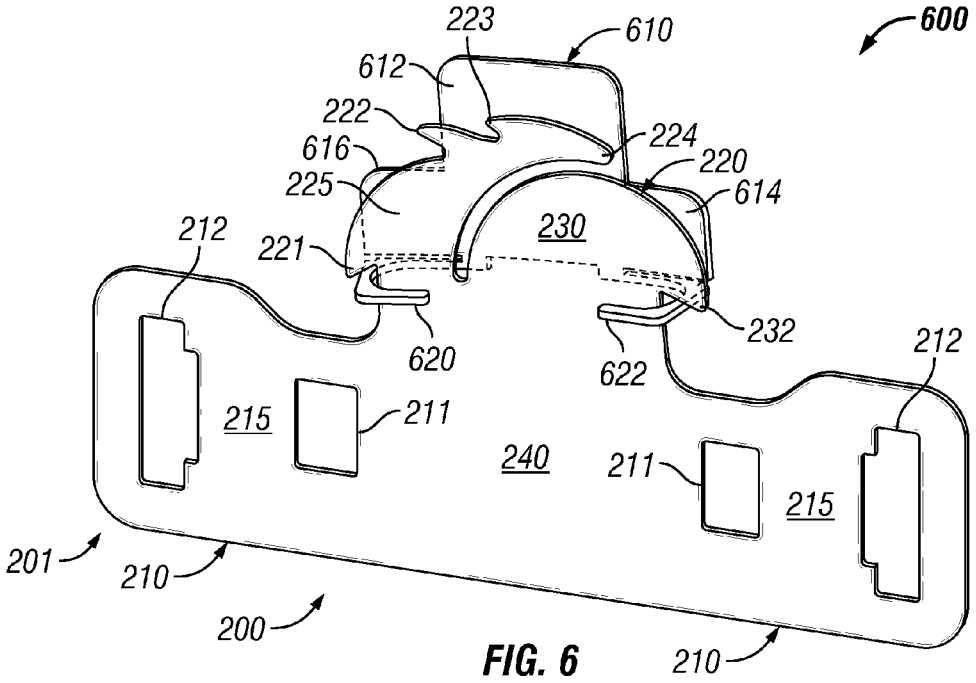
FIG. 6 shows the example socket protector of FIG. 2 coupled to yet another housing feature of a light fixture in accordance with one or more example embodiments.

FIG. 6 shows a semi-transparent view of a portion of a light fixture 600 that includes the example socket protector of FIG. 2 coupled to yet another housing feature 610 in accordance with one or more example embodiments. In one or more embodiments, one or more of the features shown in FIG. 6 may be omitted, repeated, and/or substituted. Accordingly, embodiments of light fixtures that include socket protectors should not be considered limited to the specific arrangements of components shown in FIG. 6.

Referring to FIGS. 1A-6, the portion of the light fixture 600 includes the housing 410, as described above with respect to FIG. 4. Disposed along the housing 410 of this portion of the light fixture 600 is a housing feature 610 in the form of a mounting bracket (i.e., mounting bracket 610) that has a different shape and size than the mounting bracket 510 of FIG. 5. The mounting bracket 610 of FIG. 6 can be part of a single piece with the housing 410, formed as from a mold. Alternatively, the mounting bracket 610 can be a separate piece mechanically coupled to the housing 410 using one or more of a number of coupling methods, including but not limited to welding, rivets, clamps, mating threads, and epoxy.

The mounting bracket 610 can include one or more of a number of features for securing a component (e.g., a connector) of the light fixture 600, where the component can be the same or different than the component secured by the mounting bracket 510 of FIG. 5. The mounting bracket 610 in this case can include a right side extension 614 and a left side extension 616 that extend from a main body 612 of the mounting bracket 610. The right side extension 614 can include a bracket feature 622, and the left side extension 616 can include a bracket feature 620. Bracket feature 620 and bracket feature 622 can be used to secure the component.

If the component that is disposed within the mounting bracket 610 is not disposed within the mounting bracket 610 during shipping, then the socket protector 200 can be detachably coupled to the mounting bracket 610. For example, as shown in FIG. 6, bracket feature 620 can be detachably coupled to fixture attachment feature 221 of portion 225 of the fixture attachment portion 220, and bracket feature 622 can be detachably coupled to fixture attachment feature 232 of portion 230 of the fixture attachment portion 220. The fixture attachment portion 220 of the socket protector 200 can couple to and decouple from the mounting bracket 610 using the flexibility of the fixture attachment portion 220, as described above with respect to FIG. 4.

Figure 7:
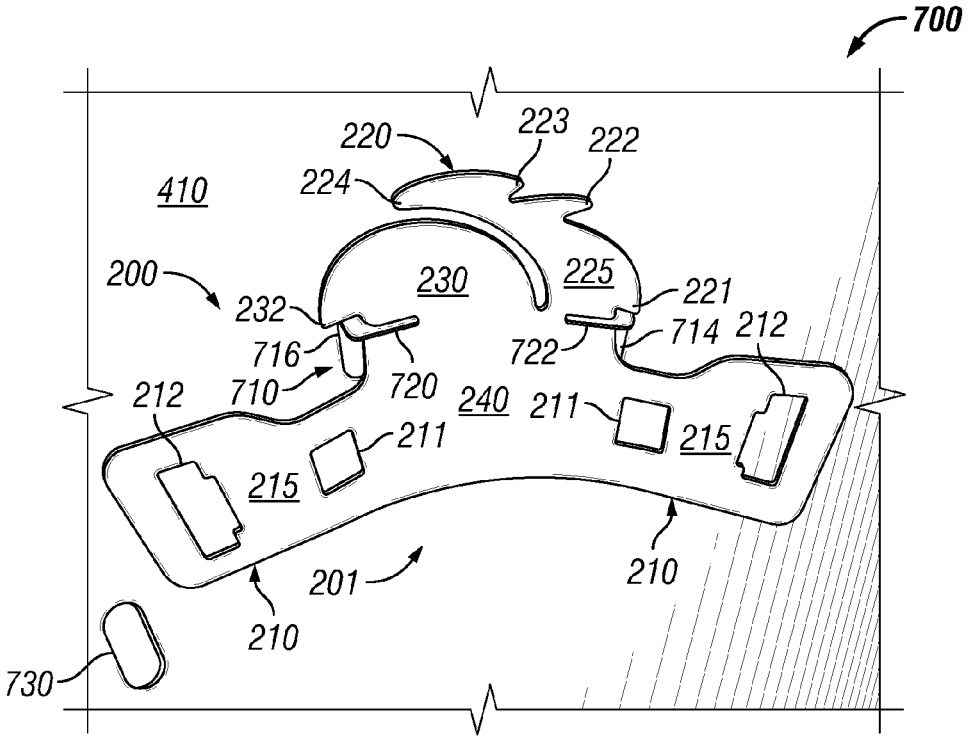
FIG. 7 shows a perspective view of a portion of a light fixture that includes the example socket protector of FIG. 2 coupled to yet another mounting bracket in accordance with one or more example embodiments.

FIG. 7 shows a perspective view of a portion of a light fixture 700 that includes the example socket protector 200 of FIG. 2 coupled to another different mounting bracket 710 in accordance with one or more example embodiments. The socket protector 200 in this case is made of a semi-transparent material. In one or more embodiments, one or more of the features shown in FIG. 7 may be omitted, repeated, and/or substituted. Accordingly, embodiments of light fixtures that include socket protectors should not be considered limited to the specific arrangements of components shown in FIG. 7.

Referring to FIGS. 1A-7, the portion of the light fixture 700 includes the housing 410, as described above with respect to FIG. 4. Disposed along the housing 410 of this portion of the light fixture 700 is a housing feature 710 in the form of a mounting bracket (i.e., mounting bracket 710) that has a different shape and size than the mounting bracket 510 of FIG. 5 and the mounting bracket 610 of FIG. 6. The mounting bracket 710 of FIG. 7 can be part of a single piece with the housing 410, formed as from a mold. Alternatively, the mounting bracket 710 can be a separate piece mechanically coupled to the housing 410 using one or more of a number of coupling methods, including but not limited to welding, rivets, clamps, mating threads, and epoxy.

The mounting bracket 710 can include one or more of a number of features for securing a component (e.g., a connector) of the light fixture 700, where the component can be the same or different than the component secured by the mounting bracket 510 of FIG. 5 and/or the mounting bracket 610 of FIG. 6. The mounting bracket 710 in this case can include a right side extension 714 and a left side extension 716 that extend from a main body 712 of the mounting bracket 710. The right side extension 714 can include a bracket feature 722, and the left side extension 716 can include a bracket feature 720. Bracket feature 720 and bracket feature 722 can be used to secure the component.

If the component that is disposed within the mounting bracket 710 is not disposed within the mounting bracket 710 during shipping, then the socket protector 200 can be detachably coupled to the mounting bracket 710. For example, as shown in FIG. 7, bracket feature 722 can be detachably coupled to fixture attachment feature 221 of portion 225 of the fixture attachment portion 220, and bracket feature 720 can be detachably coupled to fixture attachment feature 232 of portion 230 of the fixture attachment portion 220. In other words, the orientation of the socket protector 200 is reversed compared to the orientation of the socket protector shown in FIGS. 2-6. The fixture attachment portion 220 of the socket protector 200 can couple to and decouple from the mounting bracket 710 using the flexibility of the fixture attachment portion 220, as described above with respect to FIG. 4.

Figure 8:
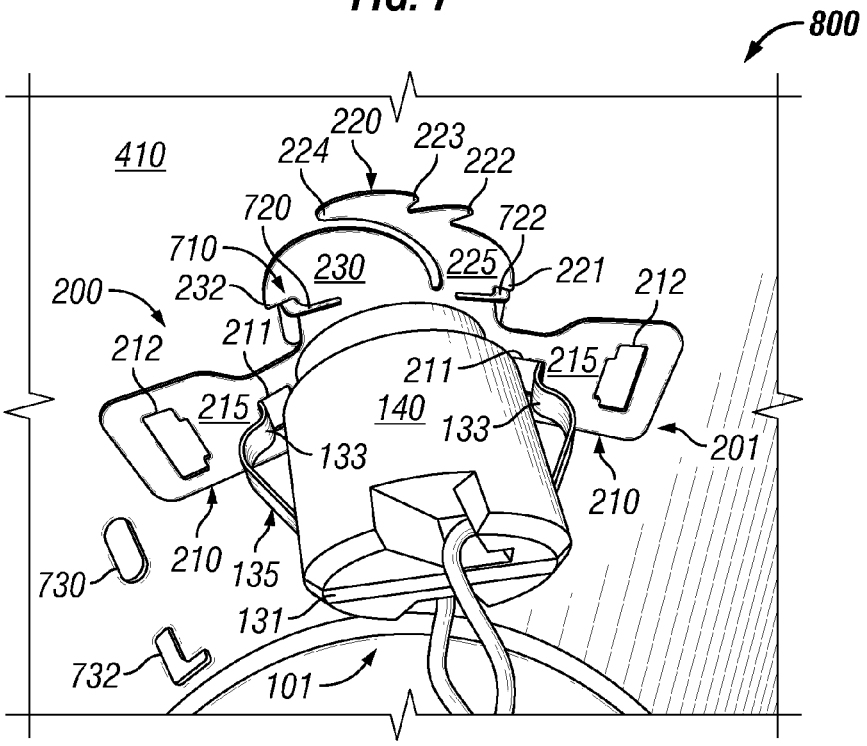
FIG. 8 shows the socket of FIG. 1B coupled to the socket protector of FIG. 7 in accordance with one or more example embodiments.

FIG. 8 shows a semi-transparent view the socket 101 of FIG. 1B coupled to the socket protector 200 of FIG. 7 in accordance with one or more example embodiments. In one or more embodiments, one or more of the features shown in FIG. 8 may be omitted, repeated, and/or substituted. Accordingly, embodiments of light fixtures that include socket protectors should not be considered limited to the specific arrangements of components shown in FIG. 8.

Referring to FIGS. 1A-8, the portion of the light fixture 800 of FIG. 8 is substantially the same as the portion of the light fixture 700 shown in FIG. 7, except that the portion of the light fixture 800 of FIG. 8 also includes the socket 101. In this case, both mounting clips 135 of the socket 101 are disposed within the pair of socket attachment features 211 of the socket attachment sections 210 of the socket protector 200. In such a case, the outward-directed portion 134 at the proximal end of each extension arm 131 extends through socket attachment features 211 disposed on either side of the main body 240. In addition, the rounded inward-facing portion 133 of each extension arm 131 abuts against the outer edge of the socket attachment features 211 when the mounting clips 135 of the socket 101 are detachably and mechanically coupled to the socket protector 200.

The width of the portion 134 and other portions (e.g., the rounded inward-facing portions 133) of the mounting clips 135 that are disposed in the socket attachment features 211 can be substantially the same as, greater than, or less than, the width of the socket attachment features 211. If the width of the mounting clips 135 is greater than the width of the socket attachment features 211, then the socket protector 200 (or, at least, the socket attachment sections 210) can be made of a malleable or otherwise flexible material (e.g., plastic) that can change its shape and/or be punctured by the mounting clips 135 to allow the mounting clips 135 to pass through the socket attachment features 211. When the socket protector 200 is mechanically coupled to the socket 101, the main body 240 of the socket protector 200 covers most or all of the cavity 141 of the socket 101.

To decouple the socket protector 200 from the socket 101, a user applies an inward force to the mounting clips 135 so that the portions 133 and the portions 134 (and/or other portions of the mounting clips 135) can be removed from outer edge of the socket attachment features 211 and into the central portion of the socket attachment features 211. In so doing, the portions 133 and portions 134 (and/or other portions of the mounting clips 135) can pass through the socket attachment features 211 in the opposite direction in which the portions 134 coupled to the socket attachment features 211.

The arrangement of the socket protector 200 mechanically coupled to the housing feature 710 and to the socket 101, while also being positioned between the housing 410 and the socket 101, is an example of how the example socket protector 200 can protect the socket 101 during shipping of the light fixture 800. When the shipped light fixture 800 is opened by a user, the socket protector 200, while still mechanically coupled to the socket 101, can be decoupled from the housing feature 710. At that point, the user can install the socket 101 in the light fixture 800, leaving the socket protector 200 coupled to the socket 101 until all installation steps (e.g., cleaning, sanding, painting) are completed. Once all installation steps are complete, the user can decouple the socket protector 200 from the socket 101, allowing a light source to be installed into the socket 101.

In certain example embodiments, when the socket protector 200 and the socket 101, and when the socket protector 200 and the housing feature 710, are mechanically coupled to each other in such a way that the opening of the cavity 141 of the socket 101 faces the housing 410 (or, more specifically, a wall of the housing 410), where only the main body 240 of the socket protector 200 is disposed between the socket 101 and the housing 410, the main body 240 can be omitted from the socket protector 200. In such a case, the housing 410 can replace the main body 240 in protecting the cavity 141 of the socket 101. If the main body 240 is omitted from the socket protector 200, the omission can be made by cutting out the main body 240 or by making the socket protector 200 with an opening where the main body 240 would otherwise be located. In such a case, the cut-out or opening can be of any shape and/or size while still allowing for each of the socket attachment sections 210 and the fixture attachment portion 220 to form the socket protector 200 as a single piece.

Figure 9:
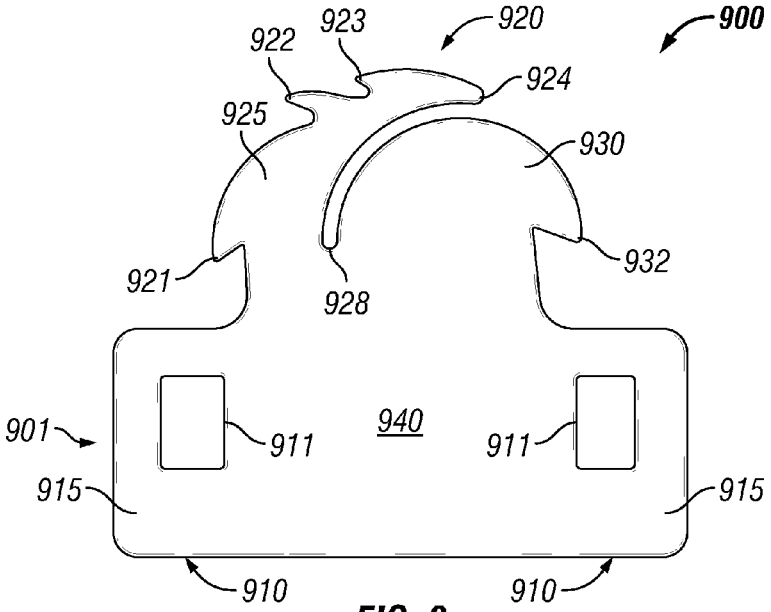
FIG. 9 shows a front view of another example socket protector in accordance with one or more example embodiments.

FIGS. 9-11 show front views of other example socket protectors in accordance with one or more example embodiments. Specifically, FIG. 9 shows a front view of socket protector 900. FIG. 10 shows a front view of socket protector 1000. FIG. 11 shows a front view of socket protector 1100. In one or more embodiments, one or more of the features shown in FIGS. 9-11 may be omitted, repeated, and/or substituted. Accordingly, embodiments of socket protectors should not be considered limited to the specific arrangements of components shown in FIGS. 9-11.

Referring to FIGS. 1A-11, the socket protector 900 of FIG. 9 is substantially the same as the socket protector 200 of FIG. 2, except as noted below. The description for any component (e.g., fixture attachment feature 922) of FIGS. 9-11 not provided below can be considered substantially the same as the corresponding component (e.g., fixture attachment feature 222) described above with respect to FIG. 2. The numbering scheme for the components of FIGS. 9-11 parallels the numbering scheme for the components of FIG. 2 in that each component is a three digit number, where similar components between the socket protectors (i.e., socket protector 900, socket protector 1000, socket protector 1100) and the socket protector 200 have the identical last two digits.

The socket attachment section 910 of the socket protector 900 in this case has only one pair (instead of two pairs, as shown in the socket protector 200 of FIG. 2) of socket attachment features. Specifically, in this case, the socket attachment section 910 only includes socket attachment feature 911. The socket attachment portion 901 of the socket protector 900 can be shorter than the socket attachment portion 201 of the socket protector 200. Alternatively, the socket attachment portion 901 of the socket protector 900 can be longer than the socket attachment portion 201 of the socket protector 200. In either case, the socket attachment portion 901 of the socket protector 900 can be used for one socket or a range of sockets.

The socket protector 1000 and the socket protector 1100 have a different layout of components compared to the socket protector 200 and the socket protector 900. For example, the fixture attachment portion 1020 and the fixture attachment portion 1120 each have two sections that are disposed on opposite sides of the socket attachment portion 1001 and the socket attachment portion 1101, respectively. For socket protector 1000, the fixture attachment portion 1020 has a left section 1025 and a right section 1030. The left section 1025 has a single fixture attachment feature 1021, and the right section 1030 also has a single fixture attachment feature 1032. In certain example embodiments, there can be more than two fixture attachment portions 1020 disposed on one or more sides of the socket attachment portion 1001. In addition, or in the alternative, each section of the fixture attachment portion 1020 can include more than one fixture attachment feature, where each fixture attachment feature can have any of a number of shapes and/or sizes and can be disposed at any point on the section of the fixture attachment portion 1020.

As shown in FIG. 10, the socket attachment portion 1001 of the socket protector 1000 can include a pair of socket attachment sections 1010, where each socket attachment section 1010 includes half of two pairs of socket attachment features (i.e., socket attachment feature 1011 and socket attachment feature 1012). Between the socket attachment sections 1010 of the socket attachment portion 1001 is the main body 1040. The shape and size of the socket attachment feature 1011 and/or the shape and size of the socket attachment feature 1012 can be different than or substantially the same as the shape and size of the socket attachment feature 211 and/or the shape and size of the socket attachment feature 212 of the socket protector 200 in FIG. 2, respectively. In this case, section 1025 and section 1030 of the fixture attachment portion 1020 is located adjacent to the top socket attachment section 1010.

For socket protector 1100, the fixture attachment portion 1120 also has a left section 1125 and a right section 1130. The left section 1125 has a single fixture attachment feature 1121, and the right section 1130 also has a single fixture attachment feature 1132. In certain example embodiments, there can be more than two fixture attachment portions 1120 disposed on one or more sides of the socket attachment portion 1101. In addition, or in the alternative, each section of the fixture attachment portion 1120 can include more than one fixture attachment feature, where each fixture attachment feature can have any of a number of shapes and/or sizes and can be disposed at any point on the section of the fixture attachment portion 1120.

As shown in FIG. 11, the socket attachment portion 1101 of the socket protector 1100 can include a pair of socket attachment sections 1110, where each socket attachment section 1110 includes half of a pair of socket attachment feature 1111. Between the socket attachment sections 1110 of the socket attachment portion 1101 is the main body 1140. The shape and size of the socket attachment feature 1111 can be different than or substantially the same as the shape and size of the socket attachment feature 211 of the socket protector 200 in FIG. 2. In this case, section 1125 and section 1130 of the fixture attachment portion 1120 is located at the top of the socket protector 1100, adjacent to the top socket attachment section 1110.

Figure 12:
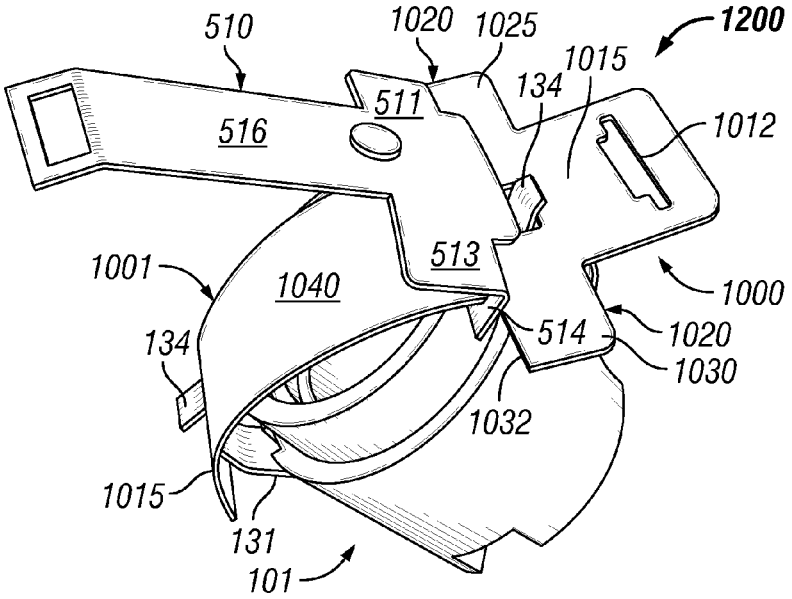
FIG. 12 shows the socket protector of FIG. 10 coupled to the socket of FIG. 1B and to a housing feature of a light fixture in accordance with one or more example embodiments.

FIG. 12 shows a portion of a light fixture 1200 that includes the socket protector 1000 of FIG. 10 coupled to the socket 101 of FIG. 1B and to the housing feature 510 of FIG. 5 in accordance with one or more example embodiments. In one or more embodiments, one or more of the features shown in FIG. 12 may be omitted, repeated, and/or substituted. Accordingly, embodiments of light fixtures that include socket protectors should not be considered limited to the specific arrangements of components shown in FIG. 12.

Referring to FIGS. 1A-12, the portion of the light fixture 1200 of FIG. 12 combines socket 101 of FIG. 1B, the mounting bracket 510 (housing feature) of FIG. 5, and the socket protector 1000 of FIG. 10. In this example, the mounting bracket 510 is held in the hand of a user rather than being mechanically coupled to a housing of the light fixture. The description for any component (e.g., main body 516) of FIG. 12 not provided below is described above with respect to FIGS. 1B, 5, and/or 10.

Both mounting clips 135 of the socket 101 are disposed within the pair of socket attachment features 1011 of the socket attachment sections 1010 of the socket protector 1000. In such a case, the outward-directed portion 134 at the proximal end of each extension arm 131 extends through socket attachment features 1011 disposed on either side of the main body 1040. In addition, the rounded inward-facing portion 133 of each extension arm 131 abuts against the outer edge of the socket attachment features 1011 when the mounting clips 135 of the socket 101 are detachably and mechanically coupled to the socket protector 200.

The width of the portion 134 and other portions (e.g., the rounded inward-facing portions 133) of the mounting clips 135 that are disposed in the socket attachment features 1011 can be substantially the same as, or slightly less than, the width of the socket attachment features 1011. When the socket protector 1000 is mechanically coupled to the socket 101, the main body 1040 of the socket protector 1000 covers most or all of the cavity 141 of the socket 101. FIG. 12 shows how flexible the socket protector 1000 is, as evidenced by the left socket attachment portion 1001.

To decouple the socket protector 1000 from the socket 101, a user applies an inward force to the mounting clips 135 so that the portions 133 and the portions 134 (and/or other portions of the mounting clips 135) can be removed from the outer edge of the socket attachment features 1011 and into the central portion of the socket attachment features 1011. In so doing, the portions 133 and portions 134 (and/or other portions of the mounting clips 135) can pass through the socket attachment features 1011 in the opposite direction in which the portions 134 coupled to the socket attachment features 1011.

FIG. 13 shows a perspective view of yet another example socket protector 1300 in accordance with one or more example embodiments. In one or more embodiments, one or more of the features shown in FIG. 13 may be omitted, repeated, and/or substituted. Accordingly, embodiments of socket protectors should not be considered limited to the specific arrangements of components shown in FIG. 13.

Referring to FIGS. 1A-13, the socket protector 1300 of FIG. 13 is a three-dimensional component, where the thickness is a significant dimension to the socket protector. The socket protector 1300 can include socket attachment portion 1301 and a fixture attachment portion 1320. The socket protector 1300 can be made from a single piece (as from a mold) or from multiple pieces mechanically coupled to each other using one or more of a number of coupling methods. Such coupling methods can include, but are not limited to, epoxy, fusion, welding, mating threads, slots, tabs, and compression fittings.

In certain example embodiments, the socket attachment portion 1301 is used to couple the socket protector 1300 to a socket (e.g., socket 100, socket 101). In this case, the socket attachment portion 1301 includes a plug 1340 that is shaped substantially the same as the cavity of the socket. The plug 1340 can include an inner wall 1341, an optional inner base 1342, an outer wall 1343, and an outer base (not shown). The socket attachment portion 1301 can include a collar 1345 that borders the top end of the plug 1340. The collar 1345 can cover a top portion of the socket adjacent to the cavity when the plug is disposed within the cavity of the socket The plug 1340 can include one or more of a number of features that allow the socket attachment portion 1301 to mechanically couple to at least one coupling feature disposed along the inner surface of the cavity of the socket. For example, the plug 1340 can include one or more friction mounting features 1312 disposed on the outer wall 1343 of the plug 1340. Each friction mounting feature 1312 can include one or more of a number of friction-generating features, including but not limited to outward-facing serrations, ridges, a textured surface, and a rubber coating. Each friction mounting feature 1312 can be used to apply friction to a coupling feature disposed along the inner surface of the cavity of the socket, allowing the plug 1340 to remain inside the cavity of the socket until a force that exceeds the frictional force imposed by the friction mounting features 1312 is applied to the plug 1340. Such a coupling feature disposed along the inner surface of the cavity can include, but is not limited to, outward-facing serrations, ridges, a textured surface, and a rubber coating.

Figure 17:
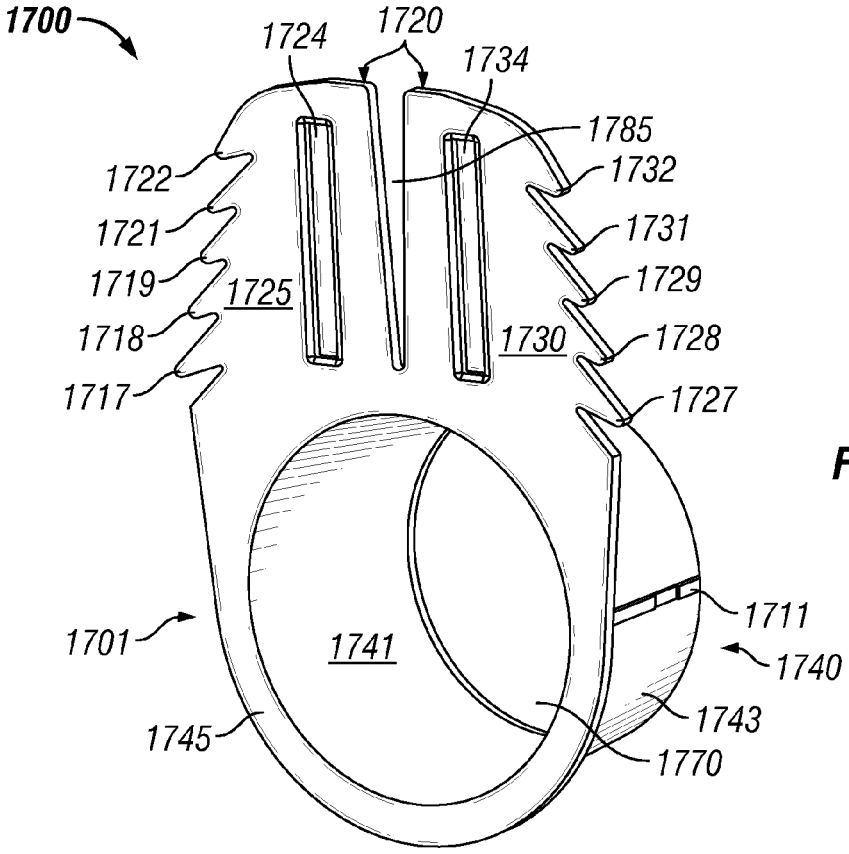
FIG. 17 shows a perspective view of still another example socket protector in accordance with one or more example embodiments.

As another example of a feature that allows the socket attachment portion 1301 to mechanically couple to a socket, the plug 1340 can include one or more socket thread mounting features 1311. Each socket thread mounting feature 1311 can be disposed on the outer wall 1343 of the plug 1340. Each socket thread mounting feature 1311 can include one or more of a number of mating threads that correspond with threads (the coupling feature) disposed along the inner surface of the cavity of the socket. When the plug 1340 is rotated in a certain direction (e.g., clockwise) within the cavity of the socket, the plug 1340 becomes threadably coupled to the cavity of the socket. When the plug 1340 is rotated in the opposite direction (e.g., counter-clockwise) within the cavity of the socket, the plug 1340 becomes threadably uncoupled from the cavity of the socket. In some cases, as shown in FIG. 17 below, the inner base 1342 (and, in some additional cases, a distal end and/or other portions of the inner wall 1341) of the plug 1340 can be omitted.

In certain example embodiments, one or more fixture attachment portions 1320 are disposed adjacent to one or more portions of the socket attachment portion 1301. In this case, there is one fixture attachment portion 1320 that has two sections (i.e., section 1325 and section 1330) that protrude from one side of the collar 1345. Each section of the fixture attachment portion 1320 can include at least one fixture attachment feature. For example, the section 1325 shown in FIG. 13 includes fixture attachment feature 1317, fixture attachment feature 1318, fixture attachment feature 1319, fixture attachment feature 1321, fixture attachment feature 1322, and fixture attachment feature 1323. As another example, the section 1330 shown in FIG. 13 includes fixture attachment feature 1327, fixture attachment feature 1328, fixture attachment feature 1329, fixture attachment feature 1331, fixture attachment feature 1332, and fixture attachment feature 1333.

As described above with respect to the socket protector 200, at least one fixture attachment feature of the socket protector 1300 can be detachably coupled to at least one housing feature of a housing of a light fixture. In certain example embodiments, there is a gap 1385 that separates section 1325 and 1330 to allow independent movement between those two sections. Gap 1385 can be substantially similar to gap 228 described above with respect to the socket protector 200. Gap 1385 can be of any shape and size.

Section 1325 and/or section 1330 of the fixture attachment portion 1320 can also include one or more strengthening features. For example, as shown in FIG. 13, section 1325 can include strengthening feature 1324, and section 1330 can include strengthening feature 1334. The optional strengthening features can be one or more slots, one or more holes, and/or one or more other features that are disposed on or traverses the corresponding section. The strengthening features can be used to add some rigidity to the corresponding section (and, more specifically, to the fixture attachment features), while the gap 1385 allows for flexibility between adjacent sections.

Figure 14:
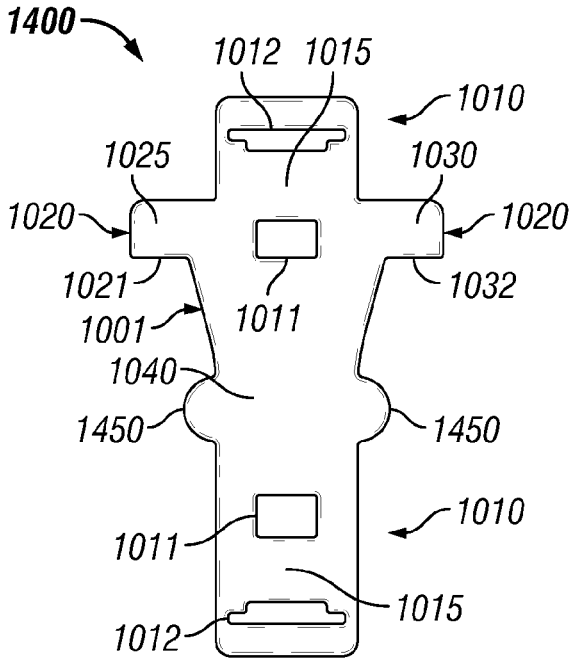
FIG. 14 shows a front view of yet another example socket protector in accordance with one or more example embodiments.

FIG. 14 shows a front view of yet another example socket protector 1400 in accordance with one or more example embodiments. Specifically, the socket protector 1400 is substantially the same as the socket protector 1000 of FIG. 10 above, except that the socket protector 1400 includes one or more locking tabs 1450. In this example, there is one locking tab 1450 disposed on each side of the main body 1040 of the socket attachment portion 1001. Each locking tab 1450 can have any of a number of shapes and/or sizes. Examples of such shapes can include a semi-circle (as shown in FIG. 14), a rectangle, a sawtooth, and random. The shape and/or size of one locking tab 1450 can be the same as, or different than, the shape and/or size of other locking tabs 1450 of the socket protector 1400.

The locking tabs 1450 can be used to prevent the socket protector 1400 from decoupling from a mounting feature and/or a socket. The locking tabs 1450 can be disposed on one or more other portions of the socket protector 1400 aside from, or in addition to, the outer edge of the main body 1040 of the socket attachment portion 1001. The locking tabs 1450 can be planar with the rest of the socket protector 1400. Alternatively, the locking tabs 1450 can be elevated or raised with one or more portions of the rest of the socket protector 1400.

Figure 15:
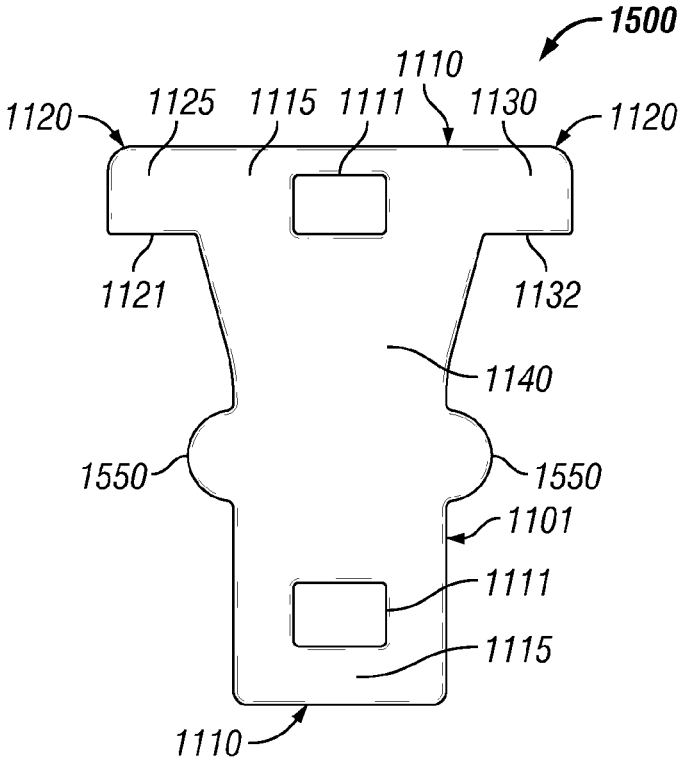
FIG. 15 shows a front view of still another example socket protector in accordance with one or more example embodiments.

FIG. 15 shows a front view of yet another example socket protector 1500 in accordance with one or more example embodiments. Specifically, the socket protector 1500 is substantially the same as the socket protector 1100 of FIG. 11 above, except that the socket protector 1500 includes one or more locking tabs 1550. In this example, there is one locking tab 1550 disposed on each side of the main body 1140 of the socket attachment portion 1101. The locking tabs 1550 can be substantially the same as the locking tabs 1450 described above with respect to FIG. 14.

FIG. 16 shows a front view of yet another example socket protector 1600 in accordance with one or more example embodiments. In one or more embodiments, one or more of the features shown in FIG. 16 may be omitted, repeated, and/or substituted. Accordingly, embodiments of socket protectors should not be considered limited to the specific arrangements of components shown in FIG. 16.

Referring to FIGS. 1A-16, the socket protector 1600 in this case is substantially the same as the socket protector 200 of FIG. 2 above, except as described below. The description for any component (e.g., fixture attachment feature 1622) of FIG. 16 not provided below can be considered substantially the same as the corresponding component (e.g., fixture attachment feature 222) described above with respect to the socket protector 200 of FIG. 2. The numbering scheme for the components of FIG. 16 parallels the numbering scheme for the components of FIG. 2 in that each component is a three or four digit number, where similar components between the socket protector 1600 and the socket protector 200 have the identical last two digits.

The fixture attachment portion 1620 of FIG. 16 has only one section 1630, instead of two sections 225 and 230 used in the fixture attachment portion 220 of FIG. 2, The section 1630 of the fixture attachment portion 1620 includes four fixture attachment features (fixture attachment feature 1621, fixture attachment feature 1622, fixture attachment feature 1623, and fixture attachment feature 1632). Each fixture attachment feature of FIG. 16 has a different shape and size compared to the other fixture attachment features. The fixture attachment features of the section 1630 are disposed along an approximate arc over a span of approximately 180°.

In addition, the socket attachment portion 1601 does not include a main body. Instead, the socket attachment portion 1601 has an aperture 1670 that traverses therethrough in the approximate place where the main body would be located. In other words, the aperture 1670 is positioned in the approximate location of the cavity of the socket when the socket attachment sections 1610 are mechanically coupled to the mounting clips (or other mounting features) of the socket. The size and/or shape of the aperture 1670 can vary, leaving some or all of the cavity of the socket exposed when the socket attachment sections 1610 are mechanically coupled to the mounting clips of the socket.

FIG. 17 shows a front view of still another example socket protector 1700 in accordance with one or more example embodiments. In one or more embodiments, one or more of the features shown in FIG. 17 may be omitted, repeated, and/or substituted. Accordingly, embodiments of socket protectors should not be considered limited to the specific arrangements of components shown in FIG. 17.

Referring to FIGS. 1A-17, the socket protector 1700 in this case is substantially the same as the socket protector 1300 of FIG. 13 above, except as described below. The description for any component (e.g., fixture attachment feature 1722) of FIG. 17 not provided below can be considered substantially the same as the corresponding component (e.g., fixture attachment feature 1322) described above with respect to the socket protector 1300 of FIG. 13. The numbering scheme for the components of FIG. 17 parallels the numbering scheme for the components of FIG. 13 in that each component is a four digit number, where similar components between the socket protector 1700 and the socket protector 1300 have the identical last two digits.

Section 1725 of the fixture attachment portion 1720 of FIG. 17 each has five fixture attachment features (fixture attachment feature 1717, fixture attachment feature 1718, fixture attachment feature 1719, fixture attachment feature 1721, and fixture attachment feature 1722), instead of six fixture attachment features used in the section 1325 of the fixture attachment portion 1320 of FIG. 13, Similarly, section 1730 of the fixture attachment portion 1720 of FIG. 17 each has five fixture attachment features (fixture attachment feature 1727, fixture attachment feature 1728, fixture attachment feature 1729, fixture attachment feature 1731, and fixture attachment feature 1732), instead of six fixture attachment features used in the section 1330 of the fixture attachment portion 1320 of FIG. 13, In addition, the plug 1740 does not include an inner base, as with the inner base 1342 of the plug 1340 in FIG. 13. Instead, the plug 1740 has an aperture 1770 that traverses the distal end of the plug 1740 in the approximate place where the inner base would be located. In other words, the aperture 1770 is positioned in the approximate location of the bottom of the cavity of the socket when the socket attachment portion 1701 is mechanically coupled to the socket. The size and/or shape of the aperture 1770 can vary, leaving some or all of the cavity of the socket exposed when the socket attachment portion 1701 is mechanically coupled to the socket.

While example socket protectors described herein show one or more pairs of socket attachment features (also called a grouping of socket attachment features) to cover the cavity of one socket, an example socket protector can include multiple groupings of socket attachment features to cover the cavity of multiple sockets.

The systems, methods, and apparatuses described herein allow for socket protectors to be coupled to a socket and housing of a light fixture so that the socket is protected during shipping of the light fixture. The example socket protectors described herein allow for remaining coupled to the socket after being decoupled from the housing of the light fixture. In such a case, the cavity of the socket remains protected by the socket protector during installation of the light fixture. As a result, unwanted elements such as dust and paint do not enter the cavity of the socket. Thus, a single socket protector can protect the socket from breaking or cracking during shipping, and also protect the cavity of the socket during installation of the light fixture.

In addition, one example socket protector can be used to protect (couple to) a number of different socket types (having different shapes and sizes). Example socket protectors can also couple to one or more of a number of different housing features having different shapes and/or sizes. The flexibility of the example socket protectors herein allow the socket protectors to be coupled to and decoupled from sockets and/or housings multiple times, making the example socket protectors reusable. Example socket protectors can be two dimensional or three dimensional.

Further, example socket protectors can be made of inexpensive material (e.g., plastic) using an inexpensive process (e.g., stamping, molding). Thus, example socket protectors can serve the same function as two different components currently used to protect a socket during shipping and during installation, and can be produced less expensively. Further, one socket protector can be used with a variety of socket types, where socket protectors currently known in the art are designed for a specific type of socket. The ease of coupling the example socket protectors to and decoupling the example socket protectors from the housing and/or sockets makes it easier for a user to install the socket in the light fixture and assemble the light fixture, saving time, money, and material. Further, use of the example socket protectors requires no tools.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A socket protector, comprising:

a socket attachment portion comprising a main body and at least one pair of socket attachment features, wherein the at least one pair of socket attachment features is configured to detachably couple to a socket of a light fixture, and wherein the at least one pair of socket attachment features comprises a pair of apertures that traverse the main body of the socket attachment portion; and a fixture attachment portion disposed adjacent to the socket attachment portion and that is unitary with the socket attachment portion, wherein the fixture attachment portion comprises at least one fixture attachment feature that is unitary with the fixture attachment portion, wherein the at least one fixture attachment feature is configured to directly and detachably couple to at least one housing feature of a plurality of housing features of a housing of the light fixture.

2. The socket protector of claim 1, wherein the fixture attachment portion comprises a first section and a second section, wherein the first section detachably couples to a first housing feature of the plurality of housing features, and wherein the second section detachably couples to a second housing feature of the plurality of housing features.

3. The socket protector of claim 2, wherein the first housing feature and the second housing feature are part of a single housing feature of the plurality of housing features.

4. The socket protector of claim 2, wherein the first section and the second section are disposed on a same side of the socket attachment portion.

5. The socket protector of claim 2, wherein the first section and the second section of the fixture attachment portion move independently of each other.

6. The socket protector of claim 2, wherein the first section comprises a plurality of first fixture attachment features, and wherein the second section comprises at least one second fixture attachment feature.

7. The socket protector of claim 6, wherein the first housing feature mechanically couples to one of the plurality of first fixture attachment features, and wherein the second housing feature mechanically couples to the at least one second fixture attachment feature.

8. The socket protector of claim 1, wherein the at least one housing feature is a first mounting hook and a second mounting hook that protrude from the housing of the light fixture.

9. The socket protector of claim 1, wherein each of the at least one pair of socket attachment features comprises a pair of apertures that traverse the socket attachment portion, wherein the pair of apertures receive a pair of mounting clips of the socket.

10. The socket protector of claim 1, wherein the socket attachment portion and the fixture attachment portion are stamped from a single plastic piece, wherein the socket attachment portion and the fixture attachment portion are bendable.

11. The socket protector of claim 1, wherein the main body is configured to cover at least a portion of a cavity of the socket.

12. The socket protector of claim 1, wherein the socket attachment portion and the fixture attachment portion are formed from a mold.

13. The socket protector of claim 1, wherein the socket is shipped in the light fixture when the socket is coupled to the at least one pair of socket attachment features and when the fixture attachment portion is coupled to the at least one housing feature of the light fixture.

14. The socket protector of claim 13, wherein the socket attachment portion is disposed between the socket and a wall of the housing of the light fixture, wherein the at least one housing feature is coupled to the wall of the housing, wherein the socket attachment portion lacks a main body, and wherein the wall of the housing covers a cavity of the socket.

15. The socket protector of claim 11, wherein the at least one pair of socket attachment features comprises a first pair of socket attachment features, wherein both of the socket attachment features of the first pair of socket attachment features are symmetrically disposed with respect to each other about the main body.

16. The socket protector of claim 15, wherein the at least one pair of socket attachment features further comprises a second pair of socket attachment features, wherein both of the socket attachment features of the second pair of socket attachment features are symmetrically disposed with respect to each other about the main body.

17. The socket protector of claim 16, wherein the first pair of socket attachment features has a first configuration that differs from a second configuration of the second pair of socket attachment features.

18. A socket protector, comprising:

a socket attachment portion comprising at least one pair of socket attachment features, wherein the at least one pair of socket attachment features is configured to detachably couple to a socket of a light fixture, and wherein the at least one pair of socket attachment features comprises a pair of apertures; and a fixture attachment portion disposed adjacent to the socket attachment portion and that is unitary with the socket attachment portion, wherein the fixture attachment portion comprises at least one fixture attachment feature that is unitary with the fixture attachment portion, wherein the at least one fixture attachment feature comprises a first protrusion that extends laterally in a first direction from a side edge of the fixture attachment portion, wherein the first protrusion is configured to directly and detachably couple to a first housing feature of a plurality of housing features of a housing of the light fixture.

19. The socket protector of claim 18, wherein the at least one fixture attachment feature further comprises at least one second protrusion that extends laterally in a second direction from the side edge of the fixture attachment portion, wherein the second direction is substantially opposite the first direction.

* * * * *